US005918390A

United States Patent [19]

Ruff

[11] Patent Number: 5,918,390

[45] Date of Patent: Jul. 6, 1999

[54] BUCKET FOR A MECHANICAL EXCAVATOR

[76] Inventor: Thomas Ruff, Gobelweg 3, D-91174 Spalt, Germany

[21] Appl. No.: 08/930,558

[22] PCT Filed: Mar. 28, 1996

[86] PCT No.: PCT/EP96/01355

§ 371 Date: Dec. 1, 1997

§ 102(e) Date: Dec. 1, 1997

[87] PCT Pub. No.: WO96/30598

PCT Pub. Date: Oct. 3, 1996

[30] Foreign Application Priority Data

Mar. 30, 1995 [DE] Germany ..... 195 11 617

[51] Int. Cl.[6] ..... E02F 3/65

[52] U.S. Cl. ..... 37/430; 37/444; 37/403; 37/241

[58] Field of Search ..... 37/241, 403, 430, 37/444, 443, 411, 427; 414/722; 172/245, 247

[56] References Cited

U.S. PATENT DOCUMENTS

| | | |
|---|---|---|
| 3,034,237 | 5/1962 | Wolfe et al. . |
| 3,805,422 | 4/1974 | Stepe . |
| 4,208,814 | 6/1980 | Stone . |
| 4,691,455 | 9/1987 | Newman . |

*Primary Examiner*—Heather Shackelford
*Attorney, Agent, or Firm*—Sughrue, Mion, Zinn, Macpeak & Seas, PLLC

[57] ABSTRACT

A deep bucket (1) for exchangeable mounting at the jib head of a bucket excavator consists of three shells (2, 31, 32), which are movable relative to each other and constrainedly guided towards each other. The width of the deep bucket (1) is steplessly adjustable between a minimum value and a maximum value. At least two double scissors systems (5, 6; 7, 8) are provided for the actuation and for the parallel constrained guidance of the side shells (31, 32) in each adjusted spacing.

11 Claims, 9 Drawing Sheets

BUCKET FOR A MECHANICAL EXCAVATOR

Figure 1:
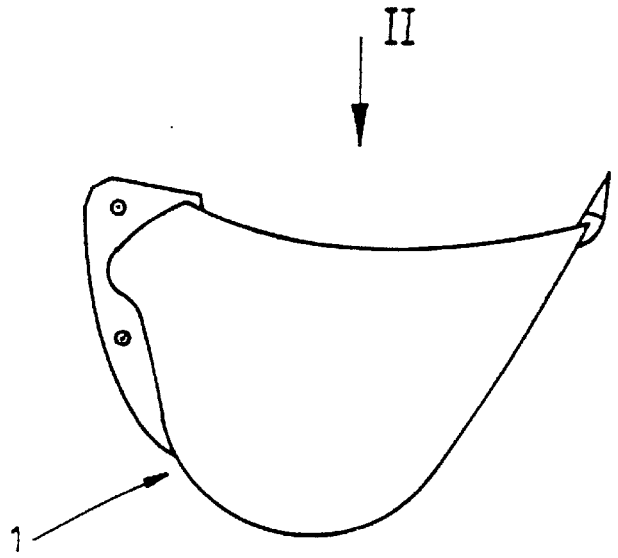

The invention relates to a deep bucket for an exchangeable mounting at the jib head of an excavator.

In the use of bucket excavators, the necessity often results of having to use deep buckets of different working widths. This means a loss of working time, which is needed for the exchange, as well as difficulties with respect to the number of the deep buckets which must be held in reserve for this purpose. The additional deep buckets must also be transported forward and stored. They must also be treated with appreciable care in order to prevent contamination of the receptacle and the hydraulic ducts. Additional deep buckets are also present only in certain widths so that the necessity often exists of having to decide on a certain bucket, which is not, however, optimum in its width. These are appreciable disadvantages of the exchange system.

A deep bucket for the exchangeable mounting at the jib head of a bucket excavator is known from European Patent 0 435 796 (Suau), wherein the deep bucket consists of at least two shells which are movable relative to each other and constrainedly guided towards each other, and the width of the deep bucket is steplessly adjustable between a minimum value and a maximum value. The constrained guidance takes place in the case of this deep bucket by mutually complementary profiles, namely a dovetail profile and a T-profile. Such constrained guides, which are based on interengaging profile sections, suffer from the severe disadvantage that the constrained guiding force becomes very much smaller with increasing adjusted spacing of the shells and the risk of mutual tipping of the shells increases. However, if a minimum amount of constrained guiding force cannot be fallen below, then the maximum possible widening of the deep bucket or the adjustability of the side parts becomes too small in order to be satisfactory for practical use, because only a deep bucket which covers a great width range brings the desired advantages in practical use.

The invention therefore has the object of providing a steplessly adjustable deep bucket, in which the force of the constrained guidance relative to each other decreases by only a small degree and the parallel guidance of the bucket parts relative to each other is ensured.

Figure 2A:
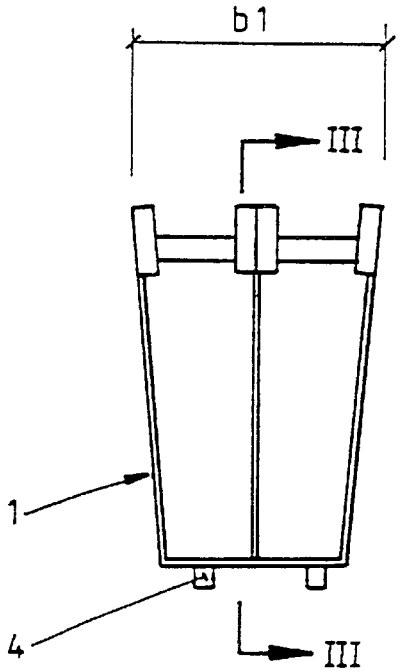
Figure 2B:
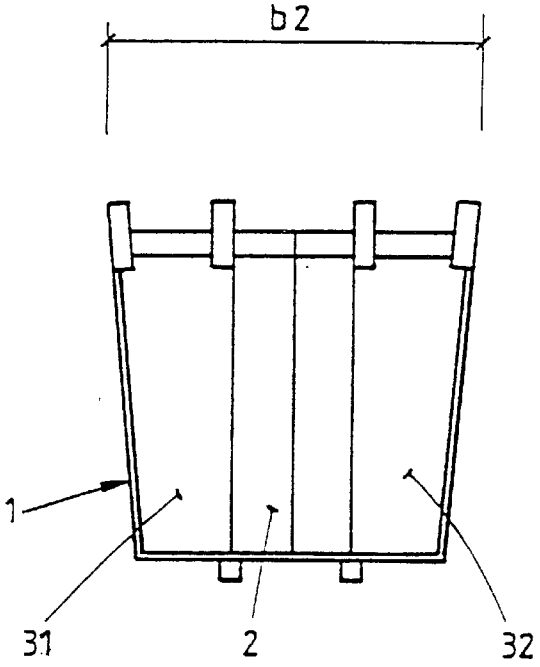
Figure 3:
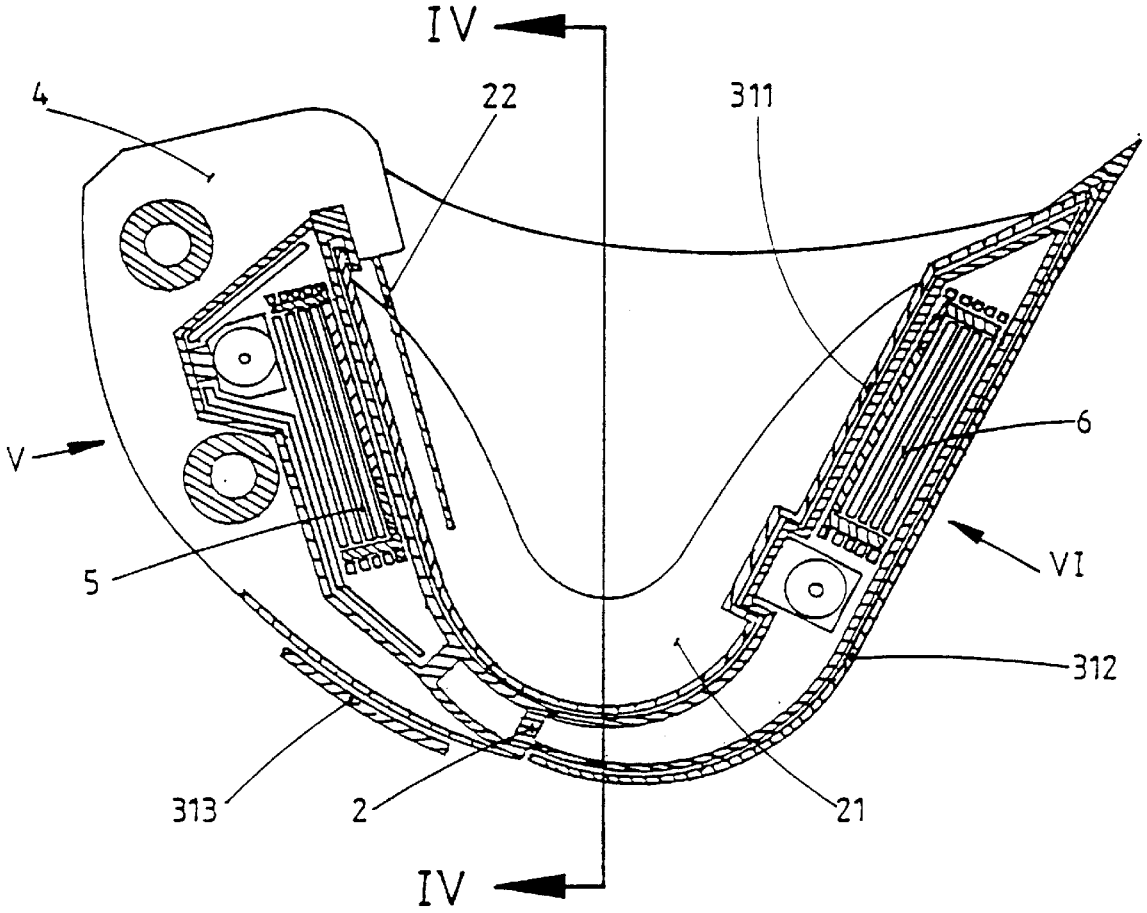
Figure 4:
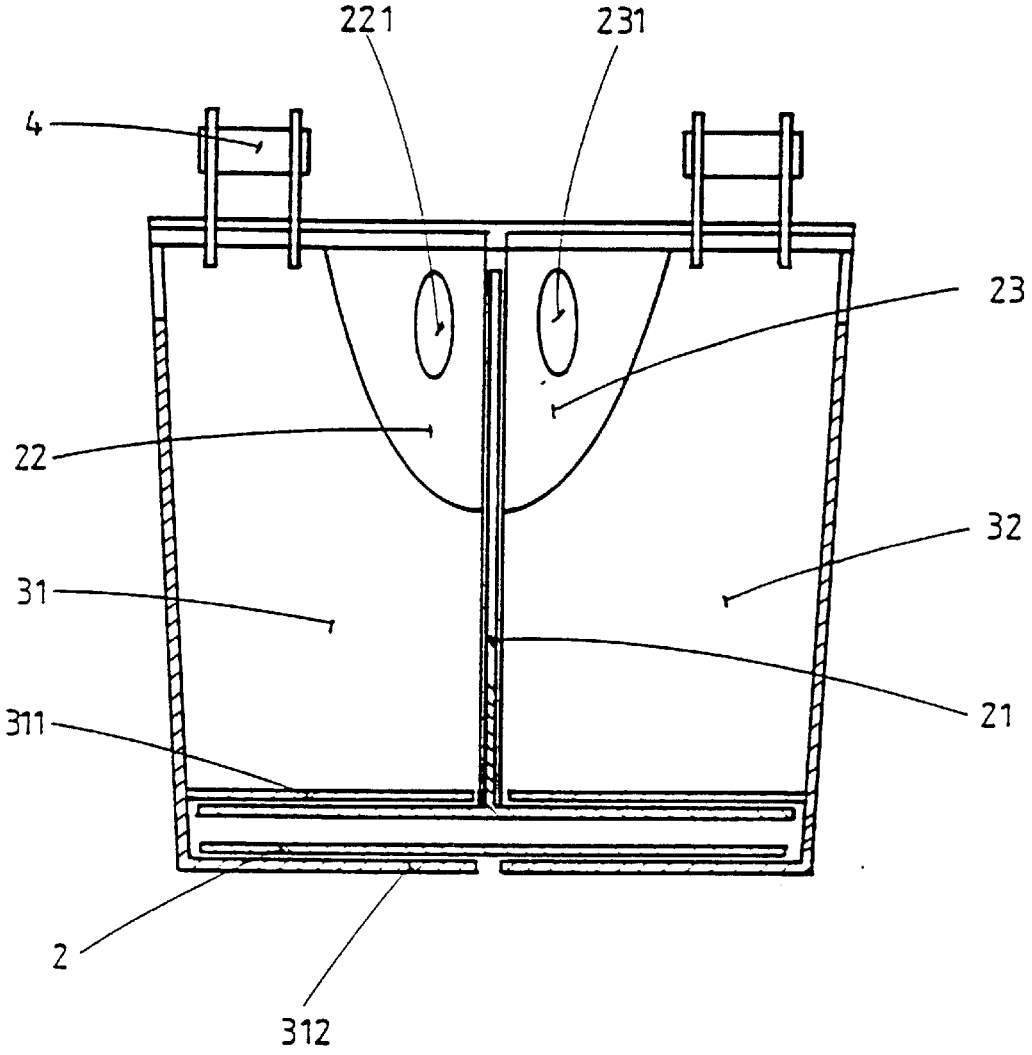
Figure 5A:
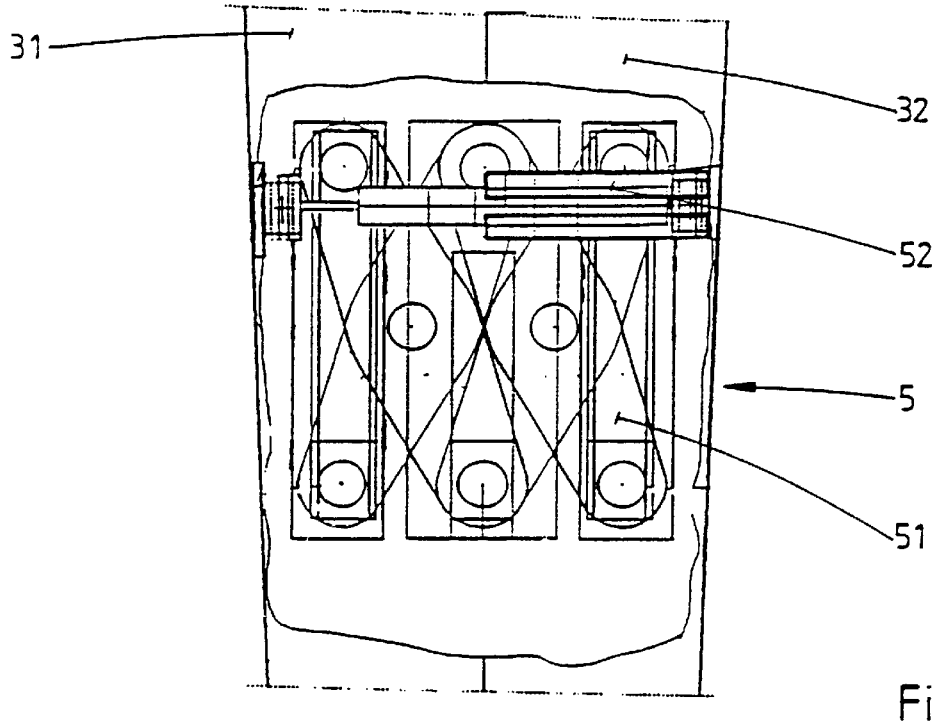
Figure 5B:
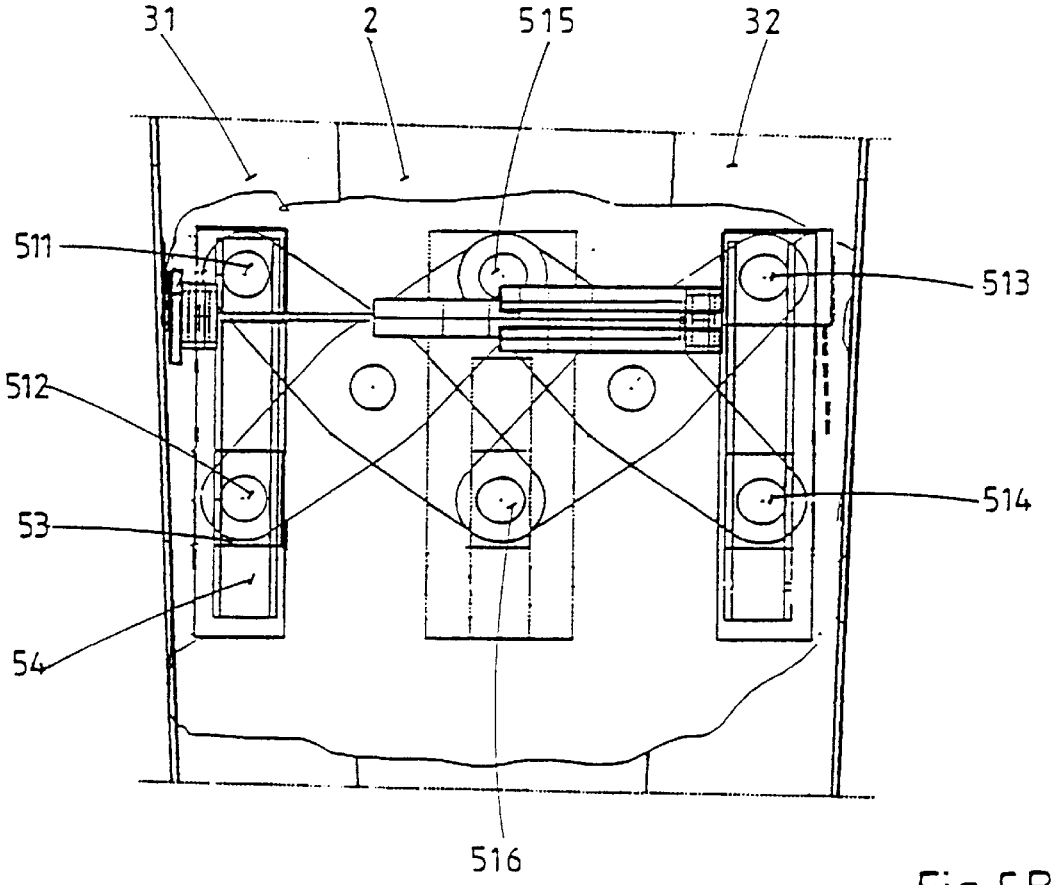
Figure 6A:
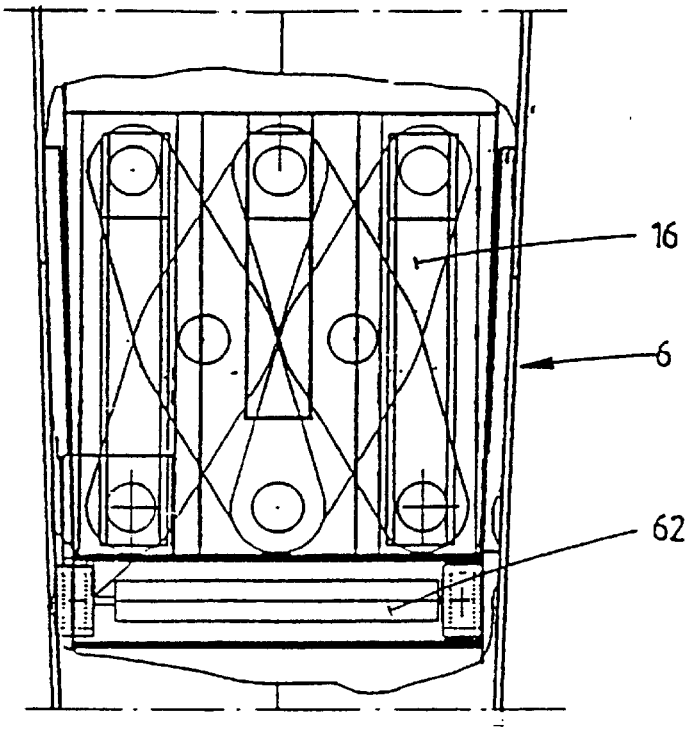
Figure 6B:
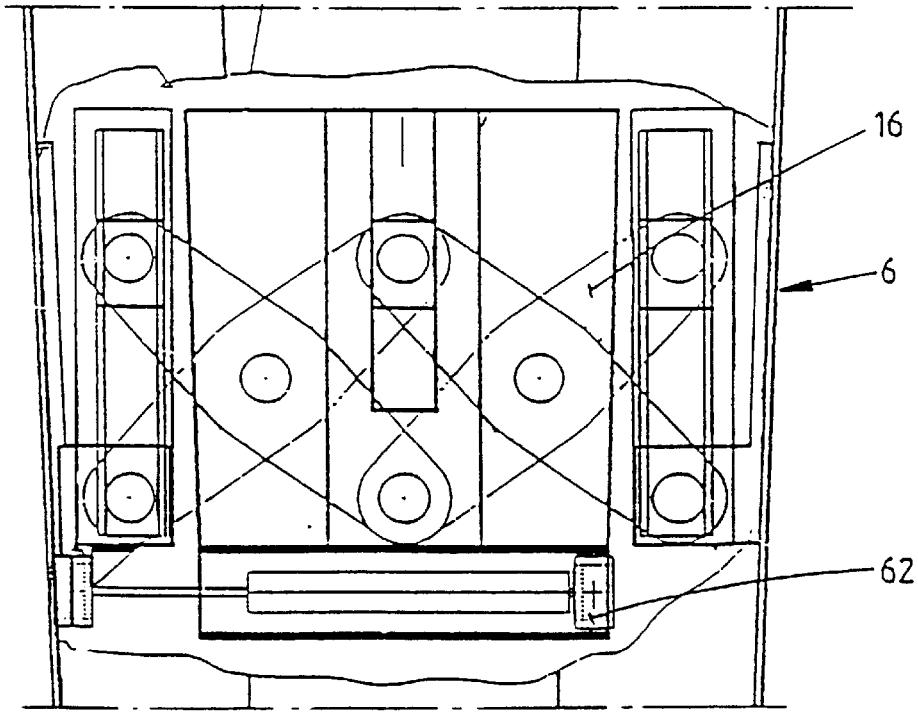
Figure 7:
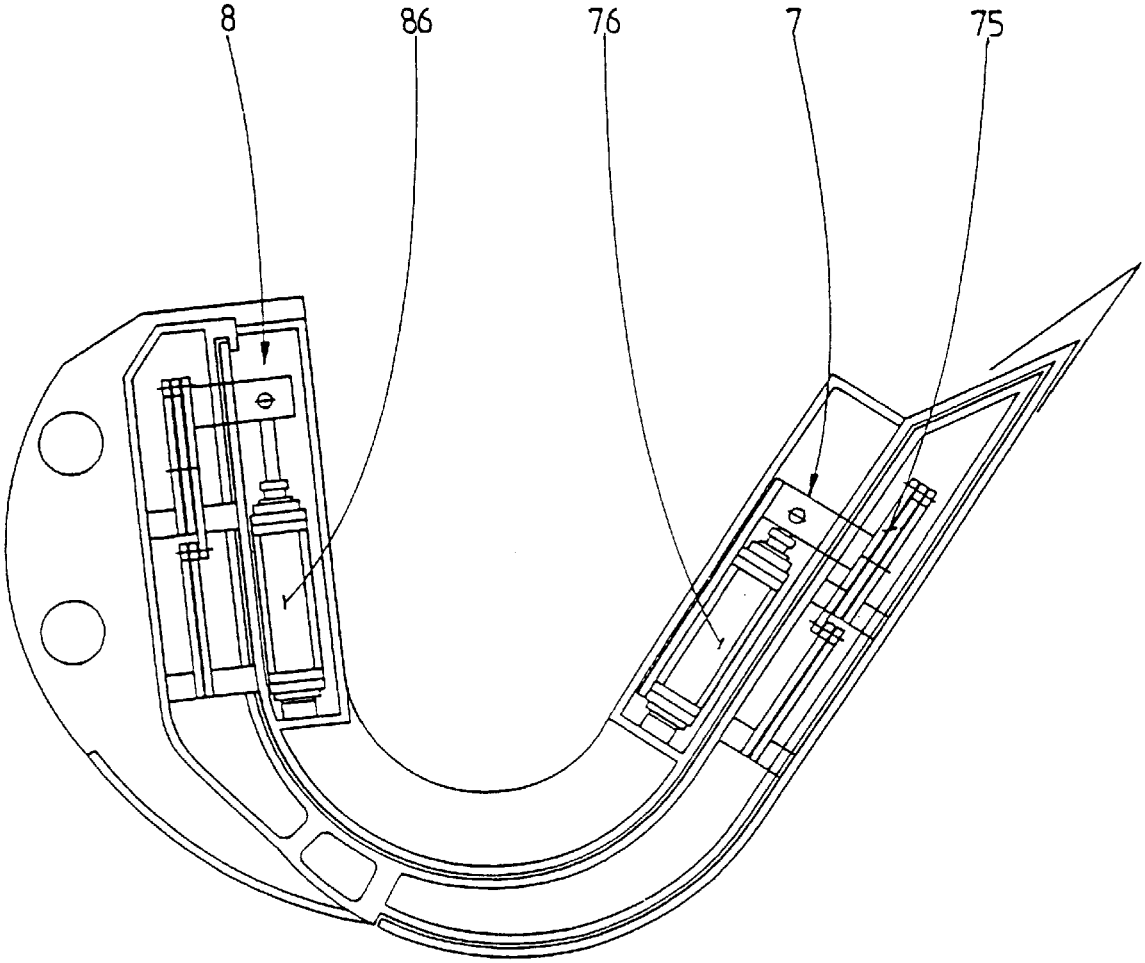
Figure 7A:
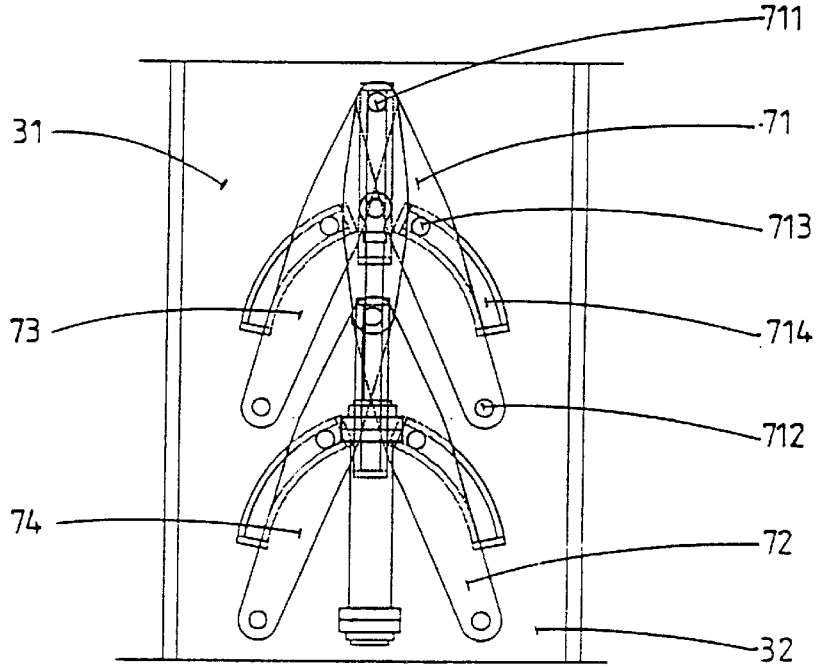
Figure 7B:
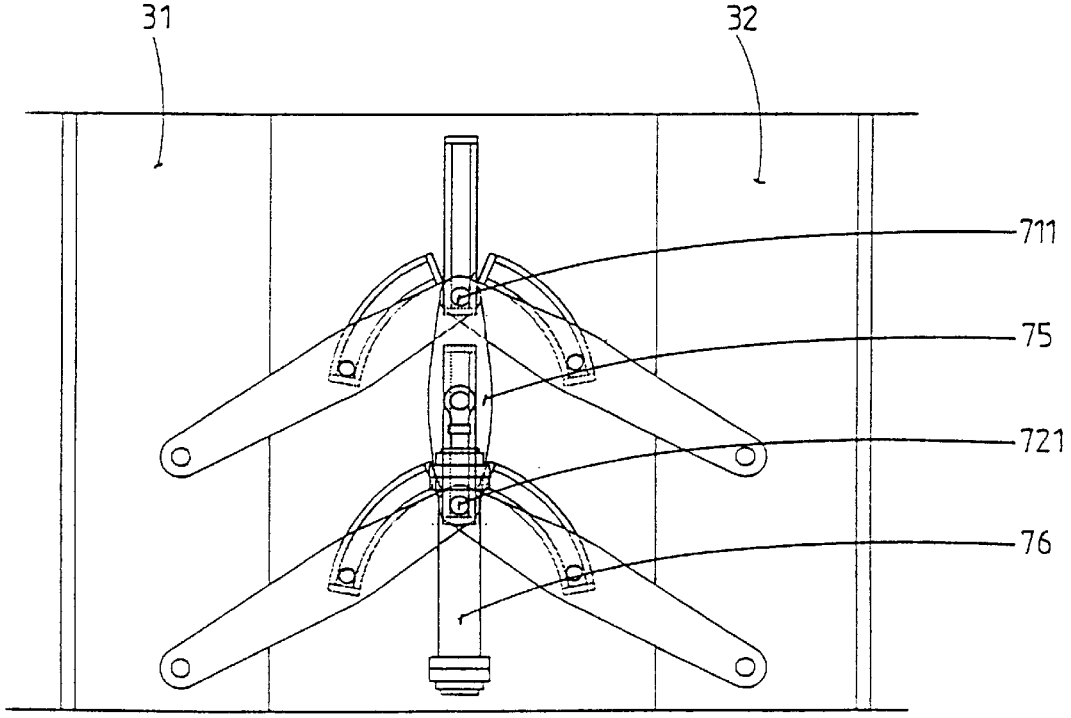
Figure 8A:
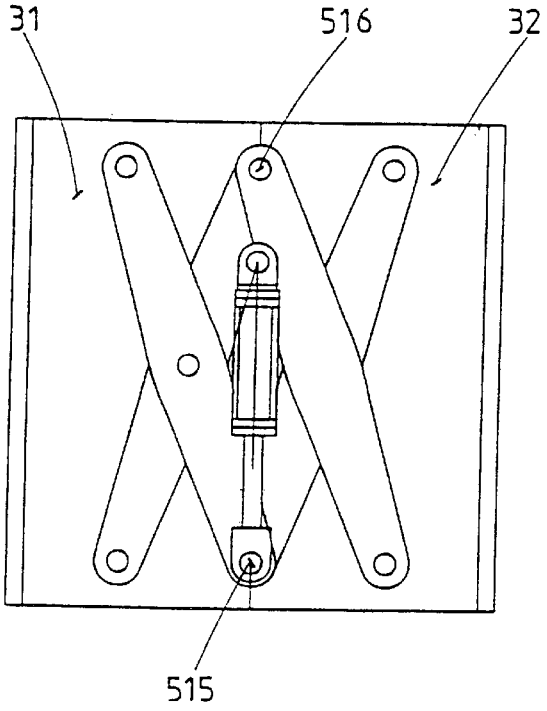
Figure 8B:
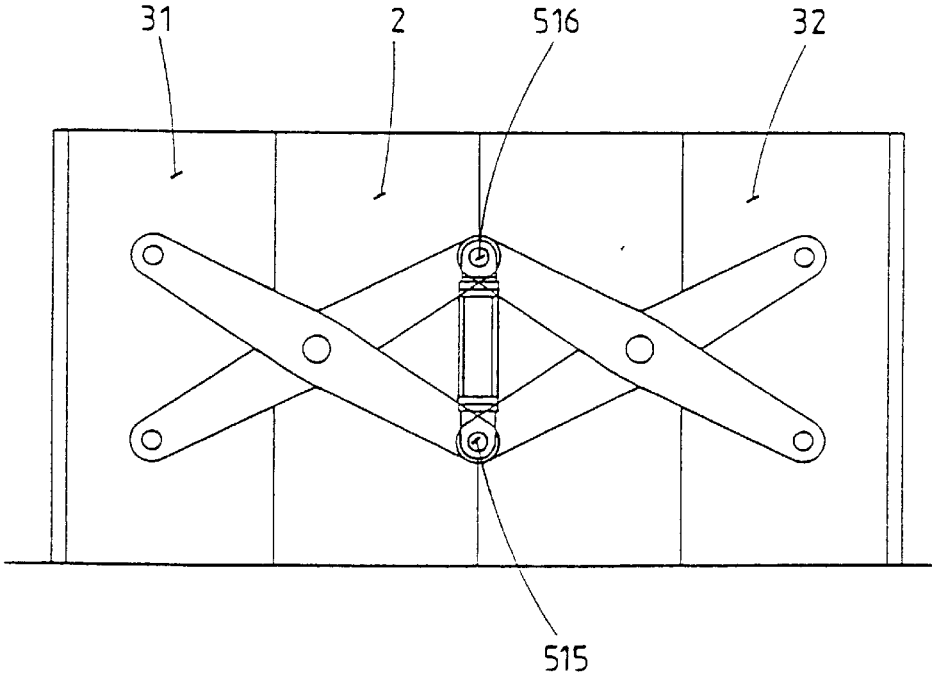
Figure 9:
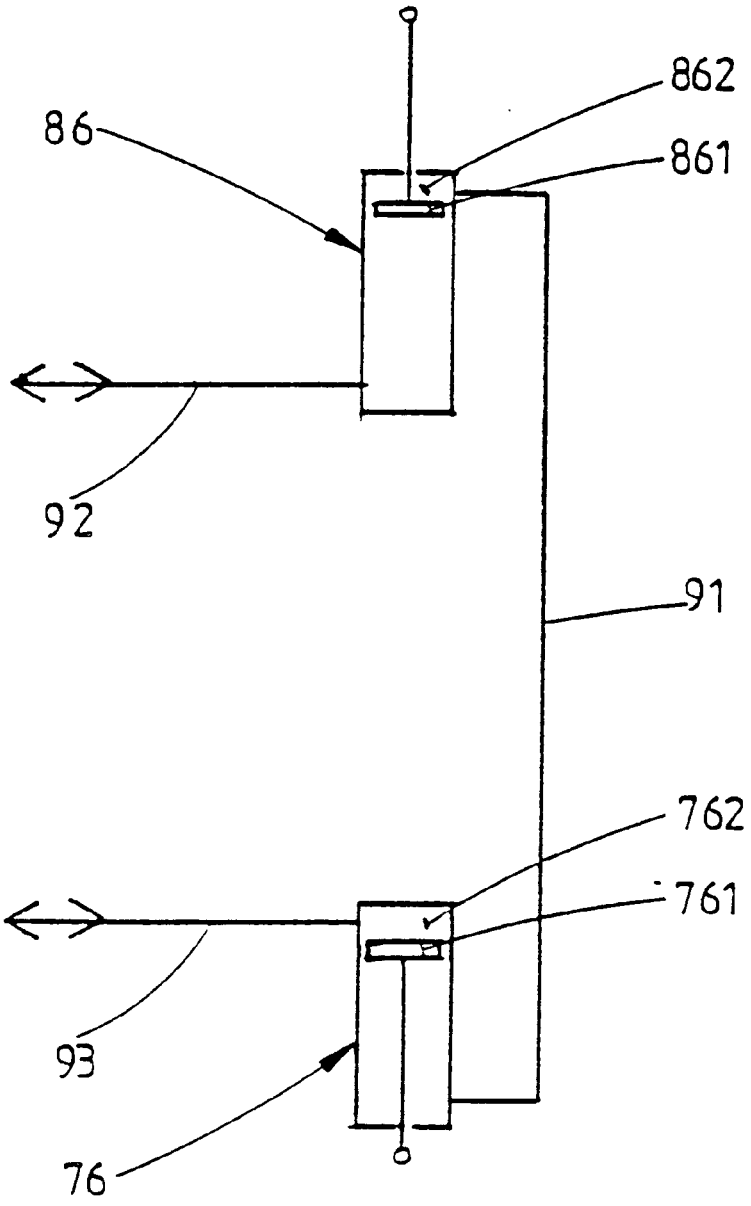

An embodiment of the invention is reproduced in the drawings. There:

FIG. 1 shows a schematic side elevation of the deep bucket of a deep bucket excavator, FIG. 2A shows a view of the deep bucket from the direction of arrow 11 of FIG. 1 in the contracted state, FIG. 2B shows as FIG. 2A, but in the extended state, FIG. 3 shows a view of the deep bucket along the section line III—Ill of FIG. 2A, FIG. 4 shows a view of the deep bucket from the direction of the section line IV—IV of FIG. 3, FIG. 5A shows a view of the deep bucket from the direction of arrow V of FIG. 3 with a broken-away wall part and contracted scissors, FIG. 5B shows as FIG. 5A, but with extended scissors, FIG. 6A shows a view of the deep bucket from the direction of arrow VI of FIG. 3 with a broken-away wall part and contracted scissors, FIG. 6B shows as FIG. 6A, but with extended scissors, FIG. 7 shows a schematic section through the deep bucket as FIG. 3 with a second scissors system, FIG. 7A shows the second scissors system in the contracted state, FIG. 7B shows the second scissors system in the extended state, FIG. 8A shows the first scissors system with changed mounting of the pressure motor in the contracted state, FIG. 8B shows the scissors system according to FIG. 8A in the extended state, and FIG. 9 shows the pressure system for the pressure motors according to the FIGS. 7 to 8B.

The deep bucket 1 for exchangeable mounting at the jib head of a not-illustrated bucket excavator is steplessly adjustable in its width between a minimum value b1 (FIG. 2A) and a maximum value b2 (FIG. 2B). The deep bucket 1 consists of a stationary central middle shell 2 and two side shells 31 and 32 which are in mirror symmetry to each other and can be moved out relative to the middle shell 2. The outward movement of the side shells 31 and 32 is constrainedly guided at the middle shell 2, wherein the constrained guidance preferably consists of at least two double scissors 5 and 6.

FIGS. 5A and 5B show the double scissors system 5 in the retracted state (FIG. 5A) and in the extended state (FIG. 5B). The double scissors system 5 consists of a double scissors 51 and a preferably hydraulic pressure piston 52 for the moving in and out of the double scissors 51. The outer hinge pair 511 and 512 at the side shell 31, the outer hinge pair 513 and 514 at the side shell 32 and the middle hinge pair 515 and 516 at the middle shell 2 are constrainedly guided by the double scissors 51. The constrained guidance takes place in the manner that the hinges 511, 513 and 515 are mounted in fixed location and to be pivotable, whilst the hinges 512, 514 and 516 are each pivotably mounted at a respective sliding body 53, which is in turn displaceable in a rail 54. Due to this constrained guidance, an absolutely parallel transmission of the pressure forces of the pressure piston 52 is effected.

In order not to allow any bending moments on the hinge pistons arise, the double scissors system 5 consists of two double scissors disposed one over the other. The arms of these double scissors engage alternately at the side shells 31 and 32. Alternately means that the first and the third arm engage at the side shell 31 and the second and the fourth arm at the side shell 32. It is evident in FIG. 3 that the two double scissors systems 5 and 6 each consist of two double scissors disposed one over the other. In FIGS. 5A and 5B, the pressure piston 52 is arranged between the fixedly located hinge 515 at the middle shell 2 and the fixedly located hinge 511 at the side shell 31. Through this arrangement of the pressure piston 52, the stroke of the pressure piston 52 is doubled by the double scissors 51. In place of the aforedescribed arrangement, however, the pressure piston 52 can also be arranged between the hinge 515 and the hinge 513. However, in principle, the possibility also exists of arranging the pressure piston 52 between the hinges 515 and 516 of a hinge pair.

The pressure piston 52 is double-acting, i.e. it exercises its pressure force in both directions, so that the side shells 31 and 32 are not only extended, but also retracted under the force of the pressure piston 52.

However, other systems for the actuation of the double scissors 51 are also possible. These can be a pneumatic pressure piston and electrical drive by a rotary spindle.

FIGS. 6A and 6B show the double scissors system 6 in the retracted state (FIG. 6A) and in the extended state (FIG. 6B). The double scissors system 6 agrees in its construction with the double scissors system 5. This scissors system, too, consists of a double scissors 61 and a preferably hydraulic pressure piston 62.

The two pressure pistons 52 and 62 are connected by way of a hydraulic flow divider or synchronising cylinder, which are not illustrated in the drawings, with the hydraulic system of the bucket excavator. The hydraulic flow divider ensures that the two volume flows of the hydraulic system are distributed uniformly over the two cylinders 52 and 62 independently of the respective back pressure. A tipping of the side shells 31 and 32 relative to the middle shell 2 is thereby prevented. As is evident from FIG. 3, the side shell 31 encompasses the middle shell 2 on the inward side by the shell part 311 and on the outward side partially by the shell parts 312 and 313. The same also applies to the side shell 32. The middle shell 2 is stiffened in the centre by a stiffening rib 21, which is in turn connected with the receptacle 4 by two triangular gusset plates 22 and 23. An assembly opening 221 and 231 for the mounting of the double scissors system 5 is situated in each triangular gusset plate 22 and 23.

The receptacle 4, by which the deep bucket 1 is fastened to the jib head of the bucket excavator, is known per se and need not be described.

The deep bucket 1 consists of individual assemblies, for example of the middle shell 2, the two side shells 31 and 32 and the scissors systems 5 and 6. These assemblies can be packed in the disassembled state and dispatched and be assembled at the receiver, which is connected with numerous advantages.

A section through a deep bucket with two double scissors systems 7 and 8 is illustrated in FIG. 7 as in FIG. 3. The two scissors systems 7 and 8 are identical, so that only the double scissors system 7 in FIGS. 7A and 7B is described in the following.

The double scissors system 7 consists of two pivot arms 71, 72 and 73, 74 at both sides. Since the four pivot arms are identically constructed and also operate identically, only the pivot arm 71 is described in the following. This has two pivotable hinges 711 and 712 and a pin 713, which is guided in a circularly arcuate template 714. The pivotable hinges 711 and 721 (FIG. 7B) are mounted at a connecting member 75, at which a pressure motor 76 (FIG. 7) engages. As is evident from FIG. 7, the two pressure motors 76 and 86 operate in opposition. They are connected as illustrated in FIG. 9 and therefore do not need a hydraulic flow divider. The side parts 31 and 32 are extended at the double scissors system 7 when the pressure piston 761 extends out of the pressure motor 76, whilst the double scissors system 8 is so installed that the side parts 31 and 32 move out with the inwardly moving pressure piston 861 of the pressure motor 86.

This completely synchronous operation of the pressure motors 7 and 8 is achieved in simple manner by the pressure chambers 762 and 862 being connected together by a pressure duct 91 according to FIG. 9. Since double-acting pressure motors are used, each of the two ducts 92 and 93 can be a feed duct as well as a discharge duct for the pressure medium.

The same applies to the double scissors system 8 according to FIGS. 8A and 8B.

List of Reference Symbols

1 deep bucket
2 middle shell
21 stiffening rib
22 gusset plate
221 assembly opening
23 gusset plate
231 assembly opening
31 side shell
311 inner shell part
312 outer shell part
313 outer shell part
32 side shell
4 receptacle
5 double scissors system
51 double scissors
511 fixedly located hinge
513 fixedly located hinge
515 fixedly located hinge
512 displaceable hinge
514 displaceable hinge
516 displaceable hinge
52 pressure piston
53 sliding body
54 rail
6 double scissors system
61 double scissors
62 pressure piston
7 double scissors system
71 pivot arm
711 pivotable hinge
712 pivotable hinge
713 pin
714 template
72 pivot arm
721 pivotable hinge
73 pivot arm
74 pivot arm
75 connecting member
76 pressure motor
761 pressure piston
762 pressure chamber
8 double scissors system
86 pressure motor
861 pressure piston
862 pressure chamber
91 pressure duct
92 duct
93 duct

I claim:

1. An excavator bucket for exchangeable mounting at the jib head of an excavator, comprising at least two shells movable relative to each other for stepless adjustment of the width of the bucket between a minimum value and a maximum value and at least two double scissors systems for actuation and constrained parallel guidance of the shells in each adjusted spacing thereof.

2. A bucket according to claim 1, comprising a center shell and two side shells disposed one on each of two opposite sides of the center shell in mirror symmetry to one another and movable towards and away from the center shell.

3. A bucket according to claim 2, comprising a respective outer hinge pair constrainedly guided at each outer shell and an inner hinge pair at the center shell by the double scissors of the double scissor systems.

4. A bucket according to claim 3, comprising hydraulic pressure drive means for driving the double scissors of the double scissor systems.

5. A bucket according to claim 4, wherein one hinge of each hinge pair is disposed in a fixed location at the respective shell and the drive means comprises a respective piston acting between the fixed location hinge of the inner hinge pair and the fixed location hinge of each outer hinge pair.

6. A bucket according to claim 4, wherein the drive means comprise a piston acting between the hinges of the inner hinge pair.

7. A bucket according to claim 3, wherein one hinge of each hinge pair is disposed in a fixed location at the respective shell and the other hinge of each hinge pair is slidably connected to the respective shell by a slide rail.

8. A bucket according to claim 2, wherein the center shell is stiffened by a stiffening rib extending centrally and in a longitudinal direction thereof.

9. A bucket according to claim 2, wherein the center shell is stiffened by a cassette stiffening.

10. A bucket according to claim 2, wherein the center shell is stiffened by a stiffening plate and by two gusset plates connected to the stiffening plate and arranged to absorb tension and compression loads.

11. A bucket according to claim 1, wherein the bucket is formed from modules.

* * * * *